United States Patent [19]

Dufresne

[11] Patent Number: 4,928,727

[45] Date of Patent: May 29, 1990

[54] FLASH FLOOD CONTROL UNITS FOR HOUSING CONSTRUCTION

[76] Inventor: Jacques Dufresne, 6889 avenue Lamont, Montréal, Québec, Canada, H4E 2T8

[21] Appl. No.: 440,648

[22] Filed: Nov. 24, 1989

[51] Int. Cl.[5] ..... E03F 3/00

[52] U.S. Cl. ..... 137/360; 137/236.1; 137/247.23; 137/565

[58] Field of Search ..... 4/209, 211; 137/357, 137/360, 362, 247.23, 236.1, 565, 590, 592; 285/120

[56] References Cited

U.S. PATENT DOCUMENTS

| | | | |
|---|---|---|---|
| 606,417 | 6/1898 | Hyde | 4/211 |
| 880,975 | 3/1908 | Conrad et al. | 137/247;23 |
| 1,109,740 | 9/1914 | Dehn | 137/362 |
| 3,815,629 | 6/1974 | Oberholtzer | 137/527.8 |
| 4,013,087 | 3/1977 | Hanna | 137/571 |

*Primary Examiner*—A. Michael Chambers
*Attorney, Agent, or Firm*—ROBIC

[57] ABSTRACT

A drainage system for housing constructions, comprising at least one fixture drain connected to a main drain, a building sewer evacuating waste waters from the main drain to the city drain, and a sump pump located in a water collecting reservoir in the basement of the housing for evacuation through a discharge line, of any water accumulating into the reservoir, the reservoir having a bottom outlet leading to the sewer. A check valve is mounted at the outlet of the reservoir to prevent backflow from the building sewer, the check valve being readily accessible from the reservoir, and a discharge line, used to expell excess waters with the sump pump, running from the pump outside of the house. The invention is useful in that the sullage can readily be evacuated outside of the housing construction when the main drain or the sewer is clogged.

15 Claims, 4 Drawing Sheets

FLASH FLOOD CONTROL UNITS FOR HOUSING CONSTRUCTION

BACKGROUND OF THE INVENTION

1(a) Field of the Invention

This invention relates to a drainage system applicable to dwellings having a basement.

1(b) Brief Description of the Prior Art

It is very common with house plumbing systems to dispose of the sullage with an assembly of fixture drains and main drains which convey those sullage directly to the city's sewer.

Those plumbing systems unfortunately suffer from several drawbacks mainly due to the fact that the main drain or the building sewer can become clogged by waste material or made inoperative because it is overwhelmed by a flood or a pouring rain.

Most houses, especially those located close to a lake or a river, are equipped with a cellar draining unit made of a reservoir and of a water pump which is preferably of the electrical sump pump type. The purpose of the reservoir is to collect rain and waste waters. When the collected water raises to a certain level, it is transferred to a sump, through a pipe, then pumped out to the sewer by the sump pump.

When the sewer is clogged, for one of the above reasons, expelled waters are driven back to the main drain and can eventually exit through the sinks and bathtub, thus becoming a great source of annoyance.

The main consequence of such an occurrence is of course, all the damage that can be caused to the floors, carpets and furniture. It can also cause the pump motor to be overdriven by the excess effort that is required from it and to break.

SUMMARY OF THE INVENTION

A first object of this invention lies in providing an improved cellar drainage unit for the disposal of domestic waste waters and rain water, which makes possible the direct evacuation of those waters outside of the construction instead of carrying it to the building sewer.

Another object of the invention resides in that the main drain of a house can be equipped with a vertical overflow safety outlet which can expell excess water directly outside of the building, when the building sewer or the city drain is made inoperative.

According to a first embodiment of the invention, the above-mentioned disadvantages can be overcome by an improved drainage system comprising at least one fixture drain connected to a main drain, a building sewer evacuating waste waters from said main drain to city drain, a sump pump located in a water collecting reservoir in the basement of the housing for evacuation of any water accumulating into said reservoir through a discharge line, the reservoir having a bottom outlet leading to said sewer. The improvements comprise a check valve mounted at the outlet of the reservoir to prevent backflow from the building sewer, the check valve being readily accessible from the reservoir, and a discharge line, used to expell excess waters with the sump pump, running from said pump outside of the house.

According to a preferred embodiment of the invention, a vertical overflow safety outlet in the form of an elbow-shaped fitting having one end connected to the main drain and another discharge end leading to the exterior of the house is connected to the main drain to drive out the waters directly on the ground lying outside of the house. In accordance with the invention, this device is advantageous because if said main drain or the city's drain is clogged for a reason or another, waste waters can be expelled directly outside the house instead of flowing back in the sinks and bathtubs.

BRIEF DESCRIPTION OF THE DRAWINGS

The invention will be better understood with reference to the following non-restrictive description of a conventional drainage system and a preferred embodiment thereof, taken in connection with the accompanying drawings in which.

DESCRIPTION OF A PREFERRED EMBODIMENT

Figure 1:
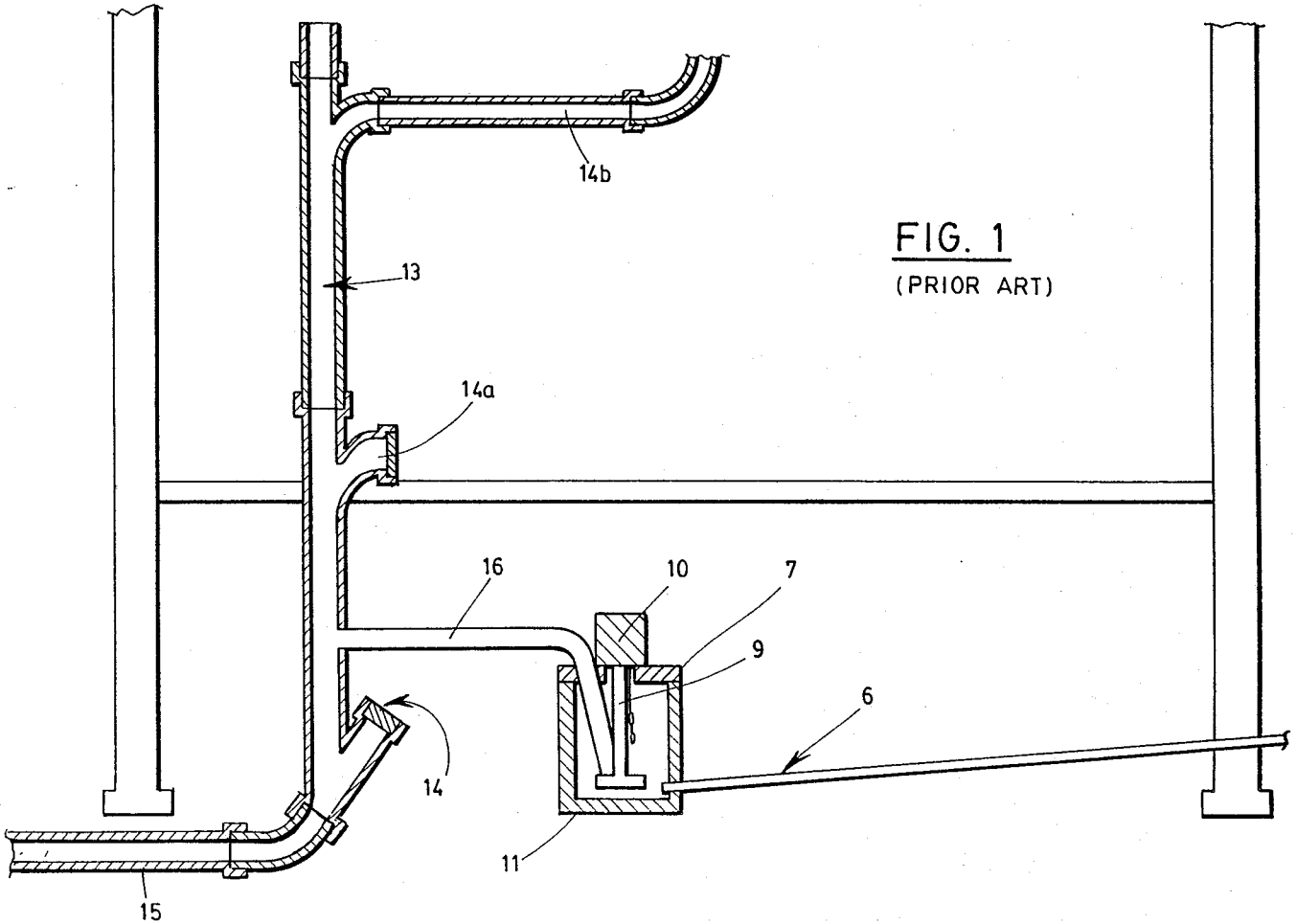
FIG. 1 (PRIOR ART)
FIG. 1 represents a conventional drainage system.

Before giving a detailed description of the invention, a brief look at a conventional drainage system is proposed. FIG. 1 shows the constitutive elements of such a classical system. The central element is the vertical soil-or-waste stack (13) whose function is to drain used waters from the various sinks, toilets and bathtubs. This drainage is carried out through a series of fixture drains (14*a,b*) joining the sinks, toilets and bathtubs, together with the soil-or-waste stack, at different levels of the latter. The bottom end of the vertical stack is connected with the city's drain through which used waters can be evacuated and flushed away towards the main sewer.

At approximately the same level with the city's drain, that is, at the cellar's level, a sump pump (10) can be encountered, especially in houses located close by a lake or a river. A sump pump receives the rain water collected by a French drain (6) and expells it through a discharge line directly into the soil-or-waste stack, where it further follows the same path as the house's waste waters. It can also serve to collect and evacuate the waters due to a rapid rising of the water level of a nearby river. It is particularly useful in regions where floods or sudden violent storms are likely to happen.

A sump pump is placed inside a sump (8) and normally comprises a pump motor (9) equipped with a float (11) which can be lifted up by the rising water, thus activating the pump motor.

At the joining point between the soil-or-waste stack (13) and the city's drain (15), a main cleanout (14) is generally placed.

There are times and situations when the system described above fails to evacuate properly the waste waters, as it ought to do. As a matter of facts, it happens all too frequently that the city's drain is clogged with wastes. When such a thing occurs, the waste waters accumulate inside the vertical stack until it reach the level of the different fixture drains, overflowing the sinks, bathtubs or toilets, causing damages to the house. If a downpour happens and the sewer is saturated, the sump pump can become a nuisance since it evacuates the rainwater directly inside the now inoperative vertical stack. Furthermore, if the sewage flows back from the city's drain toward the soil-or-waste stack and goes above the level of the discharge line of the sump pump, it can cause the latter to be overdriven by the flood and break. The classical unit described in FIG. 1 is limited by the mere fact that no emergency water evacuation system has been provided with the drainage system.

Figure 2:
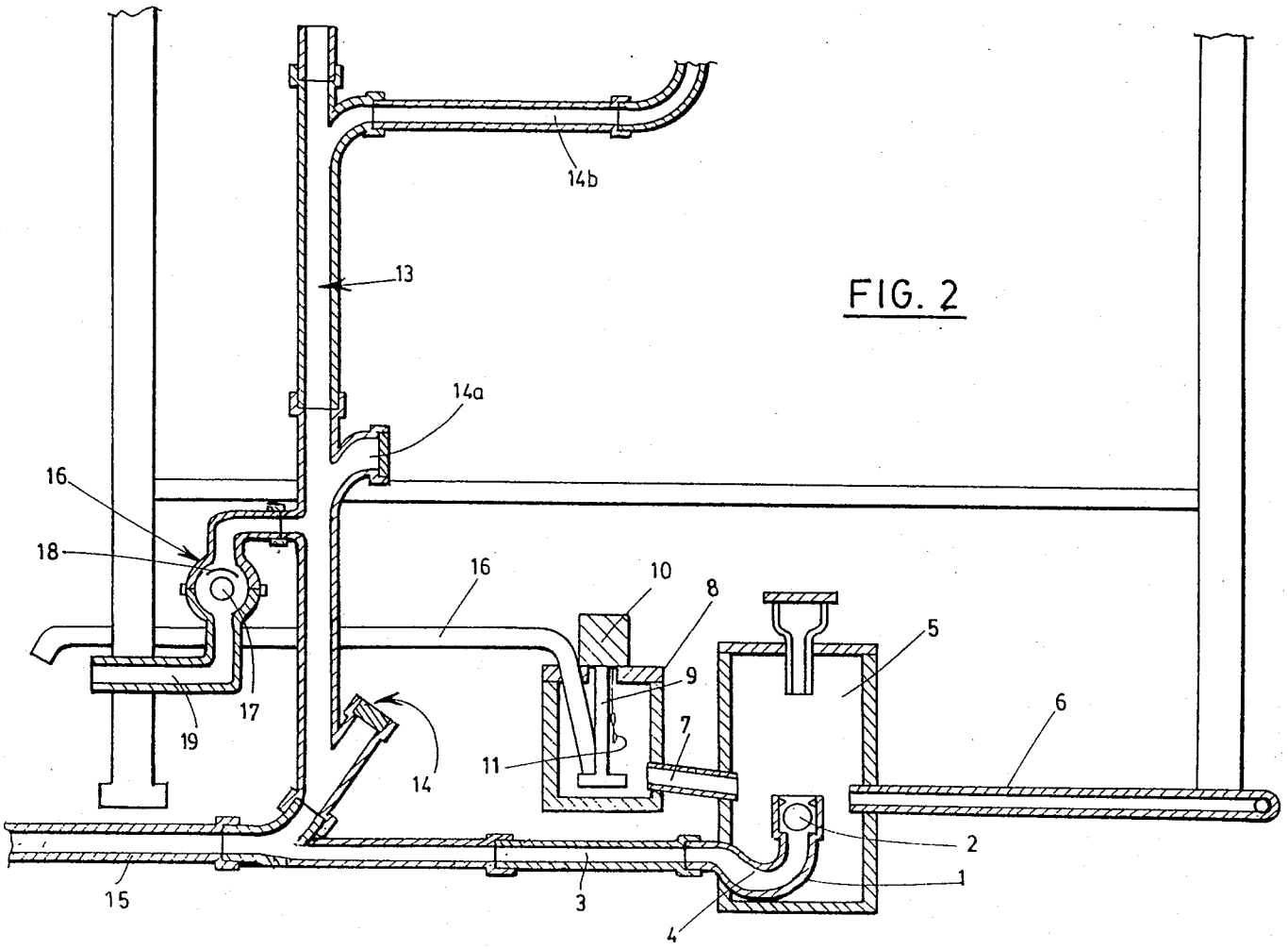
FIG. 2 represents the drainage system, reuniting the elements of FIG. 3 and 4.
Figure 3:
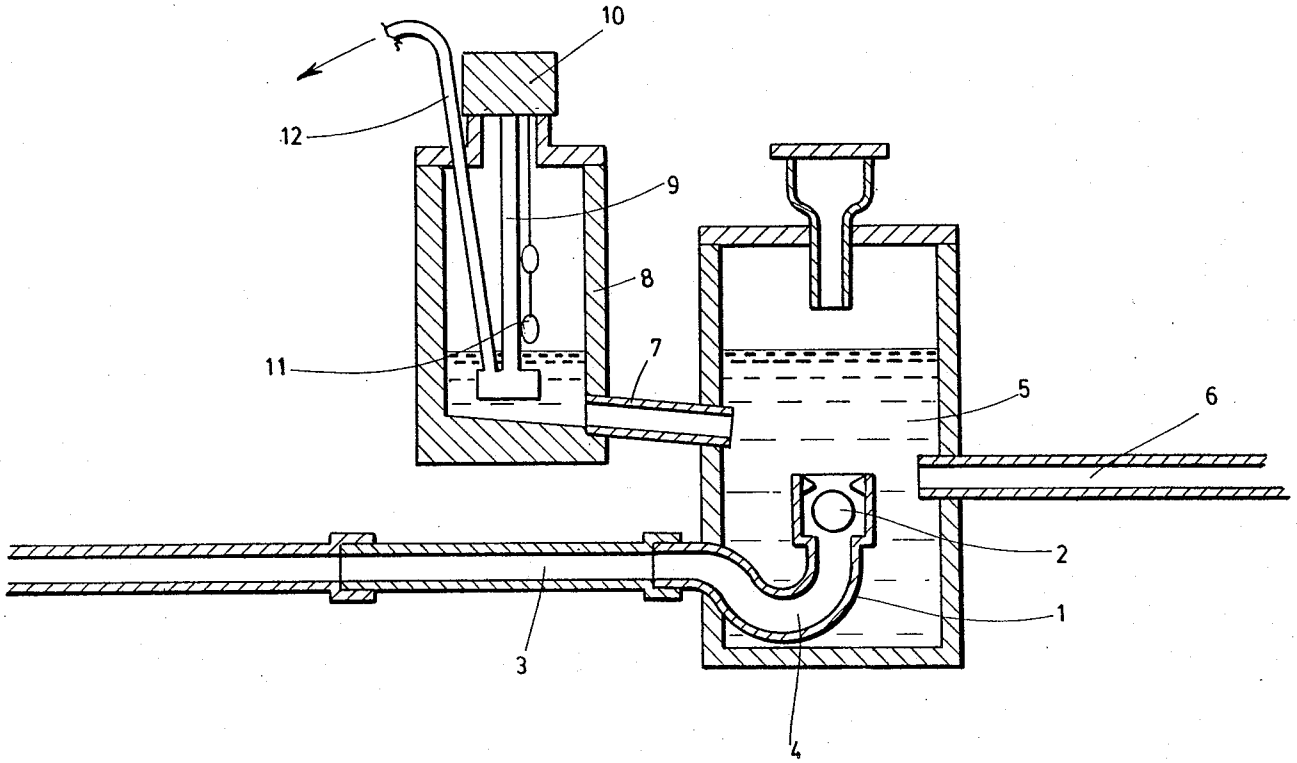
FIG. 3 represents a view of the cellar drainage unit.
Figure 4:
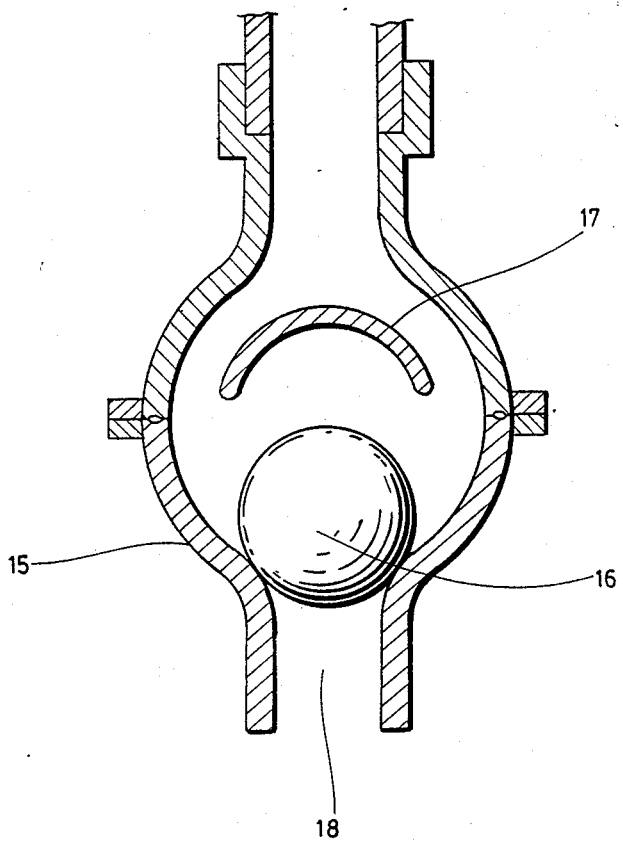
FIG. 4 represents an overflow outlet.

An improved drainage unit according to the invention is shown in FIGS. 2 and 3, which overcomes the above cited limitations. All of the elements described in FIG. 1, that is, the vertical soil-or-waste stack, the fixture drains attached to it, the city's drain located below the level of the ground and receiving the waste waters from the vertical stack, and the sump pump, are also present in the improved drainage, as it is shown in FIG. 2. A few elements have been added, which make an overflow much less probable.

The first element of the invention is a checkvalve (1) situated below the ground level, at the end of a line (3) extending from the joining point of the city's drain, the vertical soil-or-waste stack and the main cleanout. The check valve ends inside a reservoir (5) receiving the rain water through a French drain (6) and communicating with a sump (8) by means of a pipe (7). The check valve comprises a floating ball (2), enclosed in an approximately spherical cavity, normally seated at the interface between the prolongation line of the city's drain and the internal cavity of the check valve itself.

This check valve can serve two purposes. The first and most obvious one is that during a storm, the rain water accumulating in the reservoir (5) will be evacuated by the check valve as soon as the water level rises above the exit of the valve. If the reservoir (5) is filled above the level of the pipe (7), then the rain water fills up the sump, activates the sump pump and can be evacuated by the latter and through the check-valve. The second purpose of the valve is that, because of its structure, it prevents water to flow back into the reservoir (5) when the city's drain is clogged.

Another characteristic of the invention is that the sump pump, whenever it is a constitutive element of the drainage system, is no longer connected to the vertical soil-or-waste stack, as shown in FIG. 1 for a conventional drainage unit, but expells waste water directly outside of the house by means of a discharge line (12) with one end at the bottom of the sump and the other one outside of the house. In so doing, the risk of overriding the pump motor (10) is almost completely eliminated. Furthermore, if the city's drain or the vertical stack were clogged, the water eliminated by the pump (9) would still be conveyed outside of the house.

A third element characterising the present invention is an overflow outlet (16) connected to the vertical soil-or-waste stack by means of a fixture drain. The overflow outlet is situated above the ground level, and a discharge line runs from its exit end directly to the ground, outside of the house.

If, for one of the above-cited reasons, the city's drain is clogged, or the sullage starts flowing back inside the vertical stack, it will be evacuated readily outside through the overflow outlet before it can even reach the fixture drains leading to the sinks, bathtubs and toilets. When water flows inside the outlet (16), the floating ball (17) is lifted up and is stopped by the fixed cap, so that the water reaches the exit end of the outlet and flows freely. Furthermore, the ball sitting on the exit end prevents obtrusive smells from flowing outside of the house.

What is claimed is:

1. In a drainage system for a dwelling having a basement, comprising:

at least one fixture drain connected to a main drain;

a building sewer for evacuating waste waters from said main drain to a city drain; and a sump pump located in a water collecting reservoir in the basement of the housing for evacuating any water accumulating into said reservoir through a discharge line, said reservoir having a bottom outlet leading to said sewer; the improvements comprising:

a check valve mounted at the outlet of said reservoir to prevent back flow from the building sewer, said check valve being readily accessible from said reservoir; and a discharge line, used to expell excess waters with said sump pump, running from said pump outside of the house.

2. An improved drainage system of claim 1, further comprising a vertical safety outlet in the form of an elbow-shaped fitting having one end connected to said main drain and another discharge end leding to the exterior of the house.

3. An improved drainage system of claim 1, wherein said check valve is a vertically oriented automatic water shut-off enclosing a floating ball, slightly too big to go through the building sewer but still small enough to be contained in said check valve, normally seated at the interface between said sewer and said valve, and adapted to be floated up and block the exit to said valve when the water level rises up inside said building sewer.

4. An improved drainage system of claim 1, wherein said sewer forms a drain trap just before joining said check valve.

5. An improved drainage system of claim 2, wherein said sewer forms a drain trap just before joining said check valve.

6. An improved drainage system of claim 3, wherein said sewer forms a drain trap just before joining said check valve.

7. An improved drainage system of claim 1, wherein said vertical safety outlet comprises adjacent to the discharge end, a spherical cavity enclosing a floating ball and a fixed cap which prevents said floating ball, normally seated at the interface between said discharge line and said safety outlet, from blocking the entrance to said check valve, thus allowing excess water to be expelled out freely from said main drain through said discharge line.

8. An improved drainage system of claim 2, wherein said vertical safety outlet comprises adjacent to the discharge end, a spherical cavity enclosing a floating ball and a fixed cap which prevents said floating ball, normally seated at the interface between said discharge line and said safety outlet, from blocking the entrance to said check valve, thus allowing excess water to be expelled out freely from said main drain through said discharge line.

9. An improved drainage system of claim 3, wherein said vertical safety outlet comprises adjacent to the discharge end, a spherical cavity enclosing a floating ball and a fixed cap which prevents said floating ball, normally seated at the interface between said discharge line and said safety outlet, from blocking the entrance to said check valve, thus allowing excess water to be expelled out freely from said main drain through said discharge line.

10. An improved drainage system of claim 1, wherein said electrical sump pump comprises a float that activates said pump when the water level rises and shuts it off when water level falls.

11. An improved drainage system of claim 2, wherein said electrical sump pump comprises a float that activates said pump when the water level rises and shuts it off when water level falls.

12. An improved drainage system of claim 3, wherein said electrical sump pump comprises a float that activates said pump when the water level rises and shuts it off when water level falls.

13. An improved drainage system of claim 1, wherein a French drain brings rain water to said collecting reservoir.

14. An improved drainage system of claim 2, wherein a French drain brings rain water to said collecting reservoir.

15. An improved drainage system of claim 3, wherein a French drain brings rain water to said collecting reservoir.

* * * * *